US008573328B1

(12) United States Patent
Ganzinotti, II et al.

(10) Patent No.: US 8,573,328 B1
(45) Date of Patent: Nov. 5, 2013

(54) HYDROCARBON WELL COMPLETION SYSTEM AND METHOD OF COMPLETING A HYDROCARBON WELL

(75) Inventors: Edward Leonardo Ganzinotti, II, Bakersfield, CA (US); Edward Leonardo Ganzinotti, III, Bakersfield, CA (US); Brent Phillip Shanley, Bakersfield, CA (US); Matthew Anthony Couchot, Bakersfield, CA (US)

(73) Assignee: Cameron West Coast Inc., Bakersfield, CA (US)

( * ) Notice: Subject to any disclaimer, the term of this patent is extended or adjusted under 35 U.S.C. 154(b) by 284 days.

(21) Appl. No.: 13/099,302

(22) Filed: May 2, 2011

Related U.S. Application Data

(60) Provisional application No. 61/331,356, filed on May 4, 2010.

(51) Int. Cl.
*E21B 7/20* (2006.01)

(52) U.S. Cl.
USPC ..... 175/57; 166/380; 175/171

(58) Field of Classification Search
USPC ..... 175/57, 171; 166/285, 380
See application file for complete search history.

(56) References Cited

U.S. PATENT DOCUMENTS

| | | | | |
|---|---|---|---|---|
| 6,199,914 | B1 | 3/2001 | Duhn | |
| 6,920,925 | B2 | 7/2005 | Duhn et al. | |
| 7,159,652 | B2 | 1/2007 | McGuire et al. | |
| 7,322,407 | B2 | 1/2008 | Duhn et al. | |
| 7,325,610 | B2 * | 2/2008 | Giroux et al. | 166/291 |
| 7,350,562 | B2 | 4/2008 | McGuire et al. | |
| 7,416,020 | B2 | 8/2008 | Duhn et al. | |
| 7,475,721 | B2 | 1/2009 | McGuire et al. | |
| 7,484,776 | B2 | 2/2009 | Dallas et al. | |
| 7,493,944 | B2 | 2/2009 | Duhn et al. | |
| 7,520,322 | B2 | 4/2009 | Duhn et al. | |
| 7,650,936 | B2 | 1/2010 | McGuire et al. | |
| 7,654,585 | B2 | 2/2010 | Dallas et al. | |
| 7,726,393 | B2 | 6/2010 | Duhn et al. | |
| 7,775,559 | B2 | 8/2010 | Steinbock et al. | |
| 7,905,293 | B2 | 3/2011 | Dallas et al. | |
| 7,922,216 | B2 | 4/2011 | Dallas et al. | |
| 8,007,014 | B2 | 8/2011 | Youssef et al. | |
| 8,066,069 | B2 * | 11/2011 | Giroux et al. | 166/289 |
| 8,118,090 | B2 | 2/2012 | Dallas et al. | |

(Continued)

OTHER PUBLICATIONS

Weatherford Catalog section for Transfomer Wellhead System, Copyright 2009 Weatherford, nine pages.

*Primary Examiner* — William P Neuder
(74) *Attorney, Agent, or Firm* — James M. Duncan, Esq.; Klein, DeNatale, Goldner

(57) ABSTRACT

The present apparatus and method of use allows a blow out preventer to be installed as a unit with a section of casing, and does not require the blow out preventer to be removed as subsequent strings of casing are installed, thus efficiently utilizing drilling rig time. The present invention further allows a casing string to be landed and cemented in place, and then the drilling rig may move off the location, without a permanent wellhead housing attached to the well. The primary apparatus utilized in the invention is a tubular connector which suspends a string of casing during cementing, and which receives a casing plug for sealing the well when drilling operations have been completed. When completion operations commence, a permanent wellhead housing is attached to the tubular connector utilizing a unique metal to metal seal.

25 Claims, 18 Drawing Sheets

(56) References Cited

U.S. PATENT DOCUMENTS

| | | | | |
|---|---|---|---|---|
| 8,205,916 | B2 | 6/2012 | Dallas et al. | |
| 8,240,387 | B2 * | 8/2012 | Hoffman et al. | 166/336 |
| 8,272,433 | B2 | 9/2012 | Duhn | |
| 8,333,237 | B2 | 12/2012 | Duhn | |
| 8,403,078 | B2 * | 3/2013 | Brunnert et al. | 175/324 |
| 2002/0062969 | A1 | 5/2002 | Kumagai | |
| 2002/0117298 | A1 | 8/2002 | Wong et al. | |
| 2006/0185841 | A1 | 8/2006 | Swagerty et al. | |
| 2006/0196677 | A1 | 9/2006 | McGuire et al. | |
| 2008/0083539 | A1 | 4/2008 | Hickie | |

* cited by examiner

HYDROCARBON WELL COMPLETION SYSTEM AND METHOD OF COMPLETING A HYDROCARBON WELL

CROSS-REFERENCE TO RELATED APPLICATIONS

U.S. Provisional Application No. 61/331,356 for this invention was filed on May 4, 2010, for which application these inventors claim domestic priority.

BACKGROUND OF THE INVENTION

This invention pertains to downhole equipment utilized for hydrocarbon wells and is particularly directed to reducing the amount of rig time and the associated expense with drilling a hydrocarbon well.

A conventional hydrocarbon well has a plurality of concentric casing strings extending from the ground surface to the subsurface hydrocarbon reservoir, with the outermost string having the largest diameter and being the shortest in length, with each inner string having a smaller diameter and a longer length. The outermost pipe, the conductor pipe, is installed as part of site preparation and will be present when the drilling rig moves onto the location.

Once located at the site, the drilling rig drills to the next casing point, which is a predetermined depth set below freshwater bearing zones, or incompetent or difficult strata such as sloughing clay or gravel zones. Once the first casing point is reached, the surface casing is run into the well, and cemented in place, usually by pumping cement down through the inside of the casing, and continuing to pump until the cement comes out of the bottom of the casing and circulates up into the annulus between the open hole and the outside of the surface casing. The last joint of surface casing will typically be held in tension until the cement reaches a predetermined strength, at which time the blowout preventer is removed and a wellhead housing attached to the surface casing.

Drilling thereafter continues, until the next casing point is reached, at which time a smaller string of casing is run into the well through the larger diameter surface casing. Depending upon the integrity of the drilled strata and the anticipated depth of the well, the casing point may extend all of the way to the production zone and production casing installed. Alternatively, one or more intermediate strings of casing may be concentrically installed within the surface casing.

The production casing is cemented in place. After all of the cement has been pumped into place, the casing string is held stationary while the cement sets up. Thereafter, a slip-type casing hanger is placed around the top joint of the production casing, which is typically landed within the wellhead housing.

In the current method, the equipment utilized generally requires that a drilling rig be present as cement sets, and requires a blow out preventer be changed in and out as the casing installation procedure goes forward. The presently disclosed apparatus and method of use reduce the rig time associated with completing a well and it reduces the times a blow out preventer must be made up and nippled down.

SUMMARY OF THE INVENTION

The present invention discloses an apparatus and method of use which allow a blow out preventer to be installed as a unit with a section of casing, and does not require the blow out preventer to be removed as subsequent strings of casing are installed. The present invention further allows a casing string to be landed and cemented in place, and then the drilling rig may move off the location. The present invention further provides a novel wear bushing which provides a unique means of testing the blow out preventer.

In hydrocarbon well drilling operations, a bore hole is drilled by a drilling rig and the bore hole is lined first by a surface casing string, followed by a production casing string which is concentrically disposed within the surface casing string and cemented in place. In these operations, bore hole pressures are controlled by a blowout preventer assembly attached to temporary wellhead housing. Embodiments of the disclosed apparatus allows the demobilization of the drilling rig and the removal of the blowout preventer assembly and the temporary wellhead housing without the landing of the production casing and surface casing within a permanent wellhead by utilizing a tubular connector member which is attached to the top joint of the production casing string. The tubular connector member comprises a landing shoulder which lands against the top joint of the surface casing string. The tubular connector member has means, which are utilized after the drilling rig has moved off of the well, for attachment of the permanent wellhead. The tubular connector also has the necessary structure for sealing with the permanent wellhead. In order to retain control of the well after the drilling rig and blow out preventer have been demobilized from the well, the tubular connector has an internal plug receiving section which, prior to the demobilization of the blow out preventer, receives a plug which has a pump-through valve which allows circulation and well control.

DETAILED DESCRIPTION OF THE EMBODIMENTS

Figure 1:
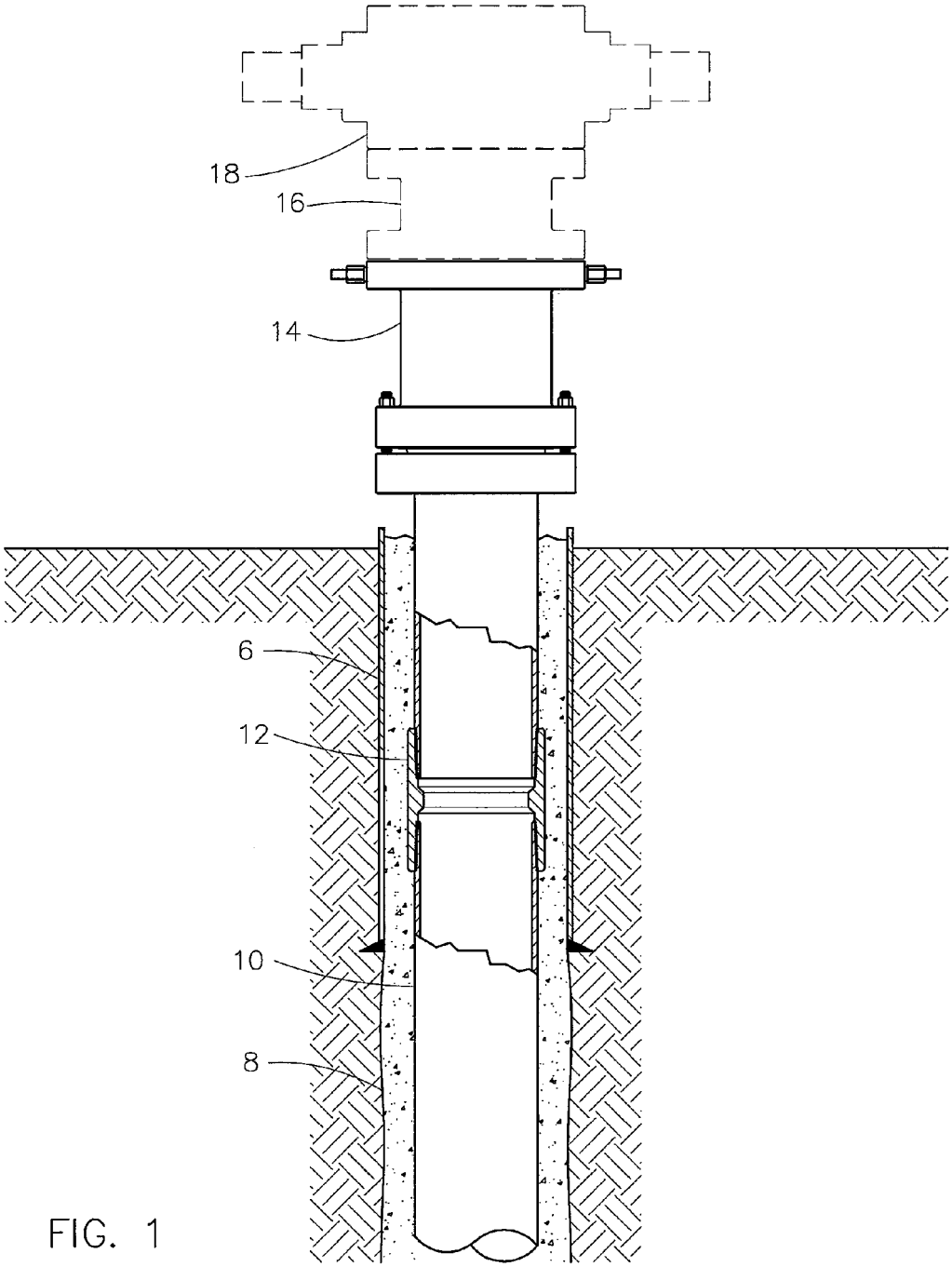
FIG. 1 schematically shows the conductor, the surface casing, a landing assembly and reusable drilling head utilized in an embodiment of the invention.

Referring now to the figures, FIG. 1 shows an initial well configuration which is utilized according to the disclosed method for application of the method and apparatus. For purposes of this disclosure, three types of oil well tubular casing are identified according to commonly used terminology, the conductor casing 6, the surface casing 10, and the production casing 34. A common oil well configuration utilizes 20" conductor, 13⅜" surface casing, 9⅝" production casing and 4½" production tubing. However, it is to be appreciated that other sizes of casing and tubing may be utilized without departing from the inventive concept. It is also to be appreciated that while the description below describes a well configuration having a surface casing string and a concentric production casing string completed with production tubing, embodiments of the disclosed method and apparatus may be utilized with intermediate casing strings and liner completions as known in the art.

As shown in FIG. 1, conductor casing 6 is installed within a borehole 8 which has been previously prepared at the well location prior to the mobilization of a drilling rig at the site. Once the drilling rig is mobilized at the well location, drilling operations commence until sufficient depth is reached below the conductor for the setting of the surface casing 10. Surface casing 10 comprising a string of individual joints of casing are run through conductor casing 6. The top joint of the surface casing 10 has a landing nipple (not shown), which is landed onto a landing ring located at the top of the conductor casing 6, and the surface casing is cemented in place. As shown in FIG. 3, surface casing 10 is made up with a casing collar 12 having a reduced bore comprising a weight supporting load shoulder, which collar is hereinafter referred to as the landing collar 12. Made up to the surface casing 10 is temporary wellhead housing 14 which, as shown in greater detail in FIG. 2, will utilize a slip-on configuration to make up to the stub of the surface casing 10. A drilling spool 16 is made up to the temporary wellhead housing 14, with the blowout preventer 18 attached to the drilling spool 16.

Figure 2:
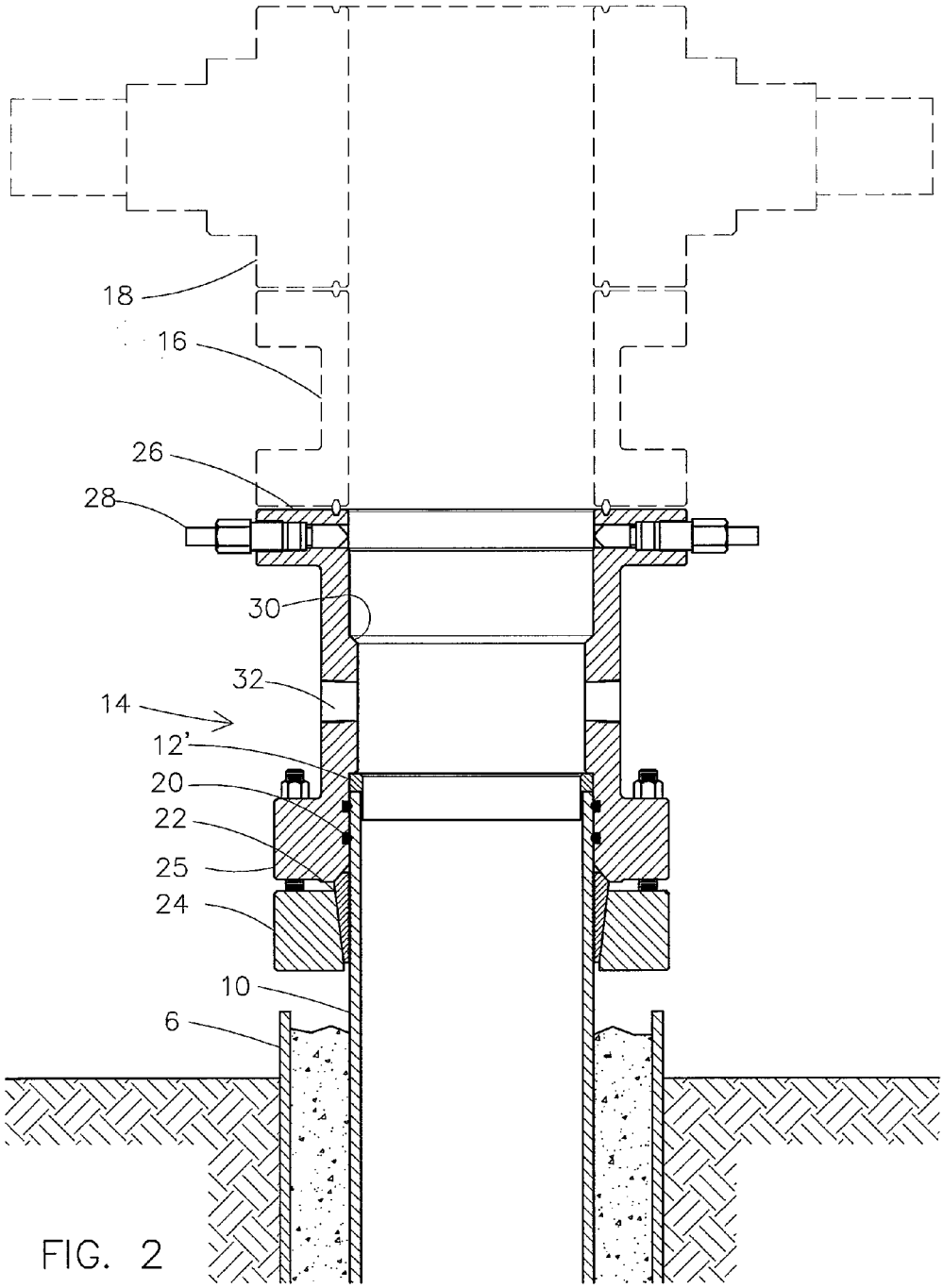
FIG. 2 schematically shows the surface casing, contingency landing means, and a reusable drilling head utilized in an embodiment of the invention.
Figure 3:
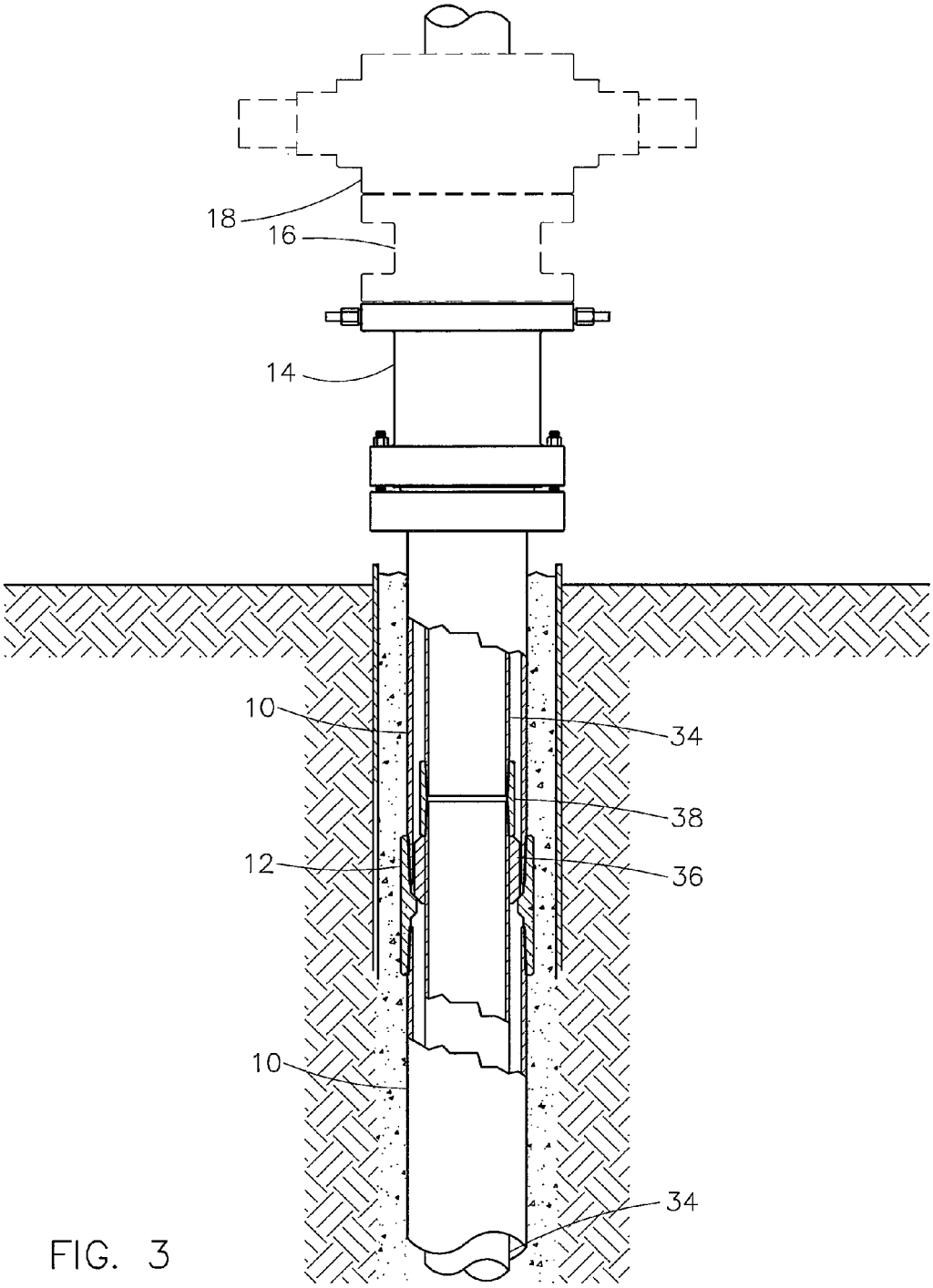
FIG. 3 schematically shows how production casing may be landed onto the landing assembly.

FIG. 2 shows how a temporary drilling head assembly 14 slips over the surface casing 10. The temporary drilling head assembly 14, also referred to as a temporary wellhead housing, comprises a conductor seal 20, a slip ring 22, a draw ring 24, a landing ring 25, a top flange 26, lock down screws 28, an internal load shoulder 30, and annulus outlets 32. As shown in FIG. 2, the slip ring 22 and draw ring 24 of the temporary drilling head assembly 14 slide over the stub of the surface casing 10 which protrudes above the conductor casing 6 and the drilling head assembly installed such that the top flange 26 is level. Surface casing 10 may be equipped with a landing ring 12', which may be utilized as an alternative or in conjunction with landing collar 12 for landing of the production casing 34 as described below.

Figures 4, 4A:
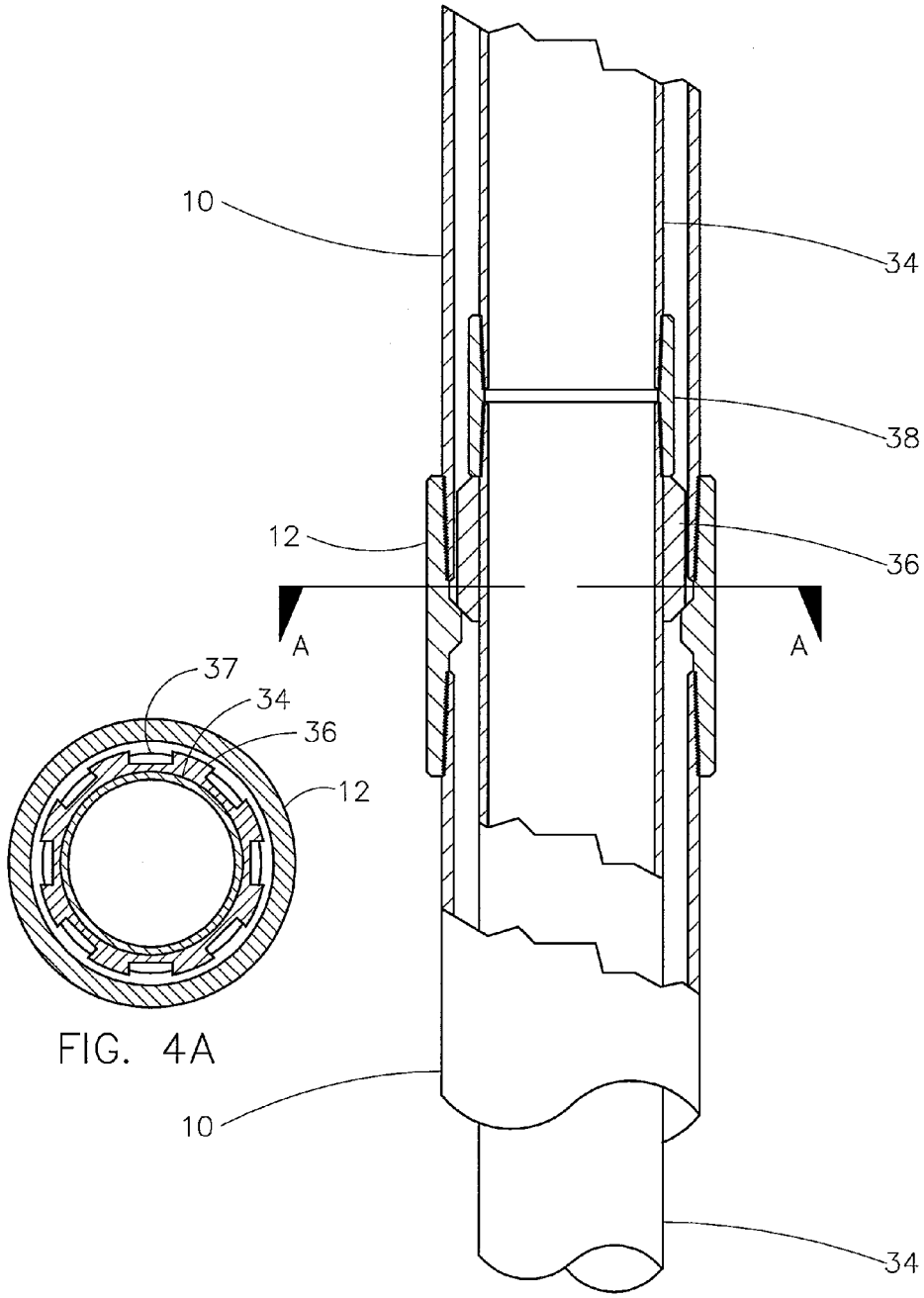
FIG. 4 schematically shows an close-up view of the landing assembly of FIG. 3.
FIG. 4A shows a sectional view taken along line A-A of FIG. 4.

Once surface casing 10 has been cemented in place and the blow out preventer 18 tested, drilling operations continue with the cleaning out of the surface casing 10 and the drilling of open hole below the surface casing. Once the desired depth for the next casing string is reached and the necessary cleanout and formation evaluation operations completed, the production casing 34 (or intermediate casing if desired) is Once the above operations have taken place and cement cleaned out of the surface casing 10, drilling operations recommence and an open hole section is drilled below the surface casing 10. Production casing 34 comprises a string of individual joints of casing which are run through surface casing 10. The production casing 34 may be landed within the surface casing 10 by alternative means. First, an upper joint of the production casing 34 may be equipped with an exterior ring 36. As shown in FIGS. 3 and 4, exterior ring 36 is located below a casing collar 38, and lands on the load shoulder of the landing collar 12. The exterior ring 36 may be equipped with means for means for facilitating circulation between the exterior ring and the landing collar 12 which allows circulation of drilling fluids and cement in the annulus between the production casing 34 and the surface casing 10. Such means for facilitating circulation may comprise openings, holes, or channels through the exterior ring 36. For example, exterior ring may comprise a plurality of flutes 37 as best shown in FIG. 4A.

As an alternative or additional means of landing the production casing 34 within the surface casing 10, the top joint of the surface casing may be equipped with a landing ring 12' having a load shoulder for a landing ring on the top joint of the production casing 34. It is to be appreciated that a means of landing the production casing 34 within the surface casing 10, while preferred, is not essential because the production casing may be held in place by the drilling rig until the cement in the surfacing casing-production casing annulus reaches the required strength.

Figure 13:
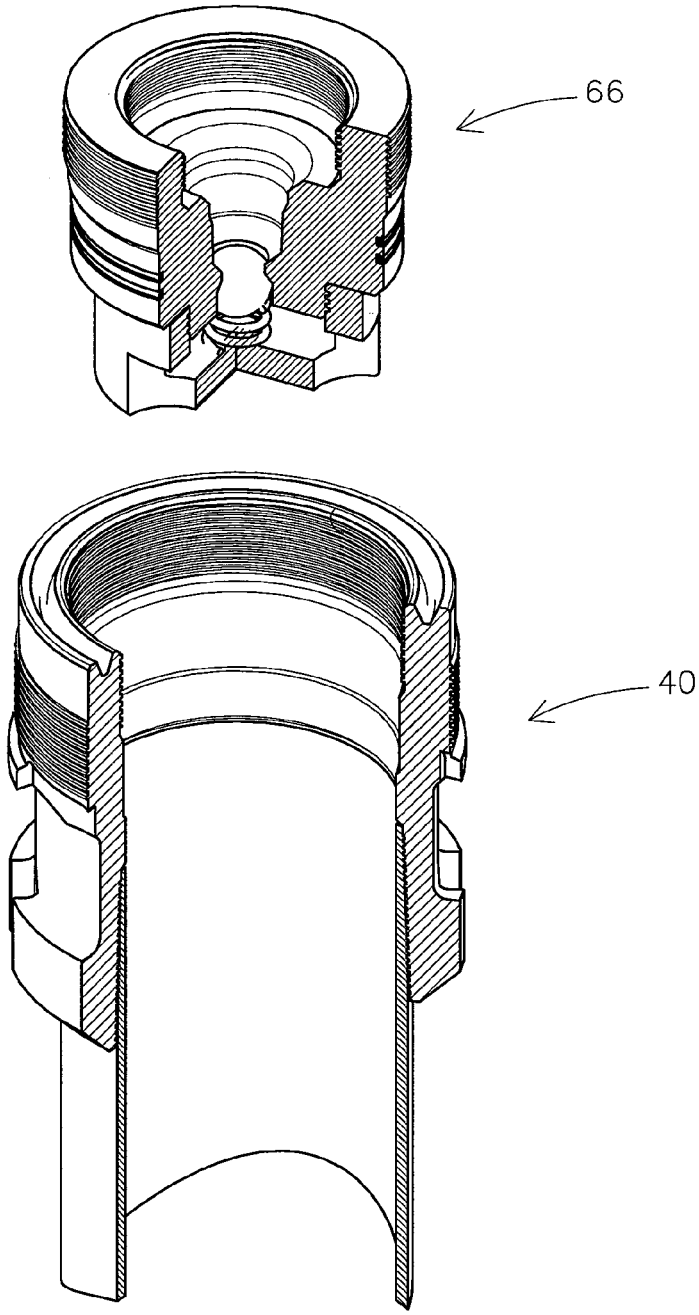
FIG. 13 shows partial cutaway perspective views of embodiments of the tubular connector member and a casing plug.
Figure 14:
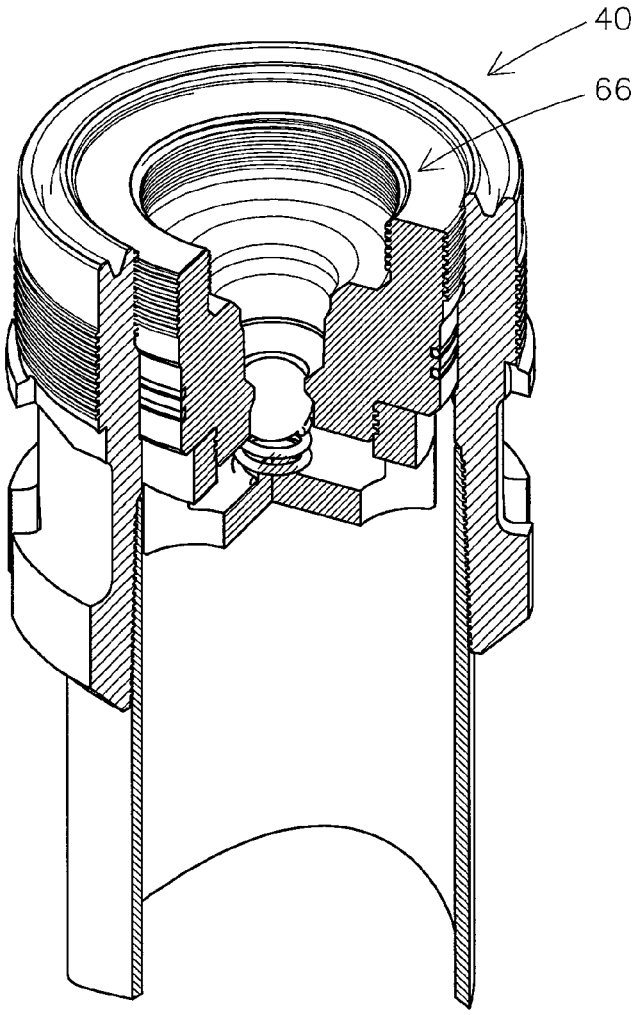
FIG. 14 shows a partially cutaway perspective view of an embodiment of a tubular connector member with a casing plug installed.
Figure 15:
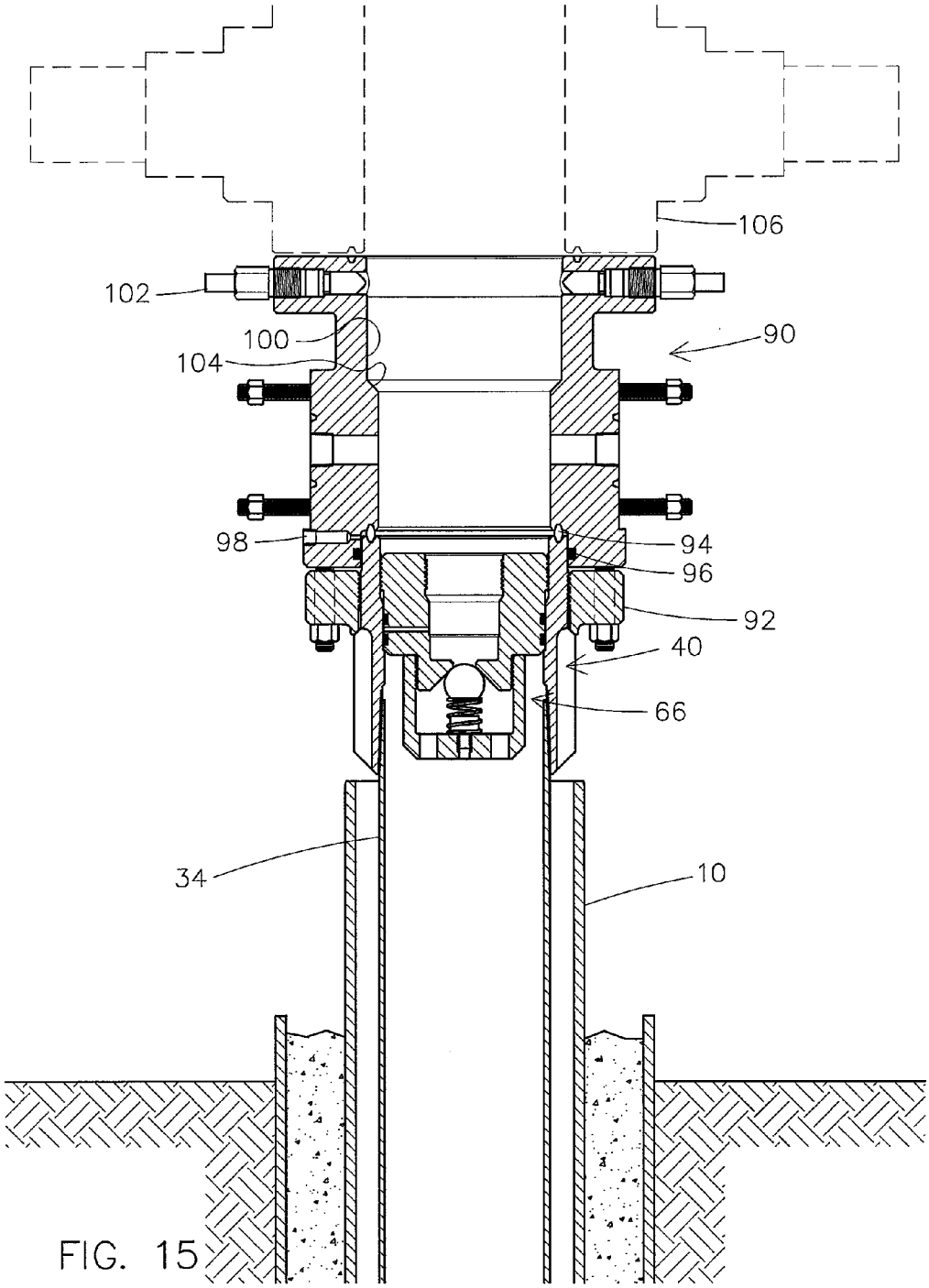
FIG. 15 schematically shows a well configuration showing a production head installed.

A tubular connector 40 is attached to the top joint of the production casing 34. The tubular connector 40, shown in detail in FIGS. 8, 13 and 14, may be utilized to suspend the production casing 34 while cementing, allows a seal surface for an annular seal, provides means for receiving a plug 66 when drilling is complete, and provides a mechanical connection to the permanent wellhead when it is installed. The plug 66 allows the drilling rig to move off location without the completion of the well or otherwise plugging the well, such as with a bridge plug. This feature allows the efficient use of the drilling rig and allows the well to be completed at a convenient and/or optimal time.

The tubular connector 40 comprises means for attaching a permanent wellhead housing, such as production head 90 described below, sealing means for sealing with the permanent wellhead housing, and an internal plug receiving section having means for receiving a plug having a pump-through valve. The tubular connector 40 may comprise circulation facilitation means, such as a plurality of flutes 46 or other types of openings, holes or channels. The tubular connector 40 further comprises threads 48 which allow the tubular connector to be suspended and which also provide a means for attachment of the permanent wellhead housing. The tubular connector 40 further comprises a ring groove 58 into which a sealing ring may be disposed for sealing between the tubing connector and the permanent wellhead when it is ultimately installed. Once the permanent wellhead is installed a metal seal ring is set within ring groove 58 to form a low stress metal seal between the mating surfaces of the tubular connector. This seal is described below in greater detail.

The lower inside of the tubular connector 40 comprises a seal bore 52 for sealing with a plug 66. The inside upper diameter of the tubing connector 40 comprises threads 54 for receiving plug 66. Threads 54 may comprise left-hand threads such that installation and retrieval of the plug 66 does not loosen the tubing connector 40 from the top joint of production casing 34. Alternatively, the inside upper diameter may comprise a latch attachment member for receiving a retaining a plug 66 having a latching mechanism. The outside upper diameter of the tubing connector 40 may comprise a sealing surface 56 for sealing with the permanent wellhead, as well as the temporary pack-off member 60 discussed below.

Figure 5:
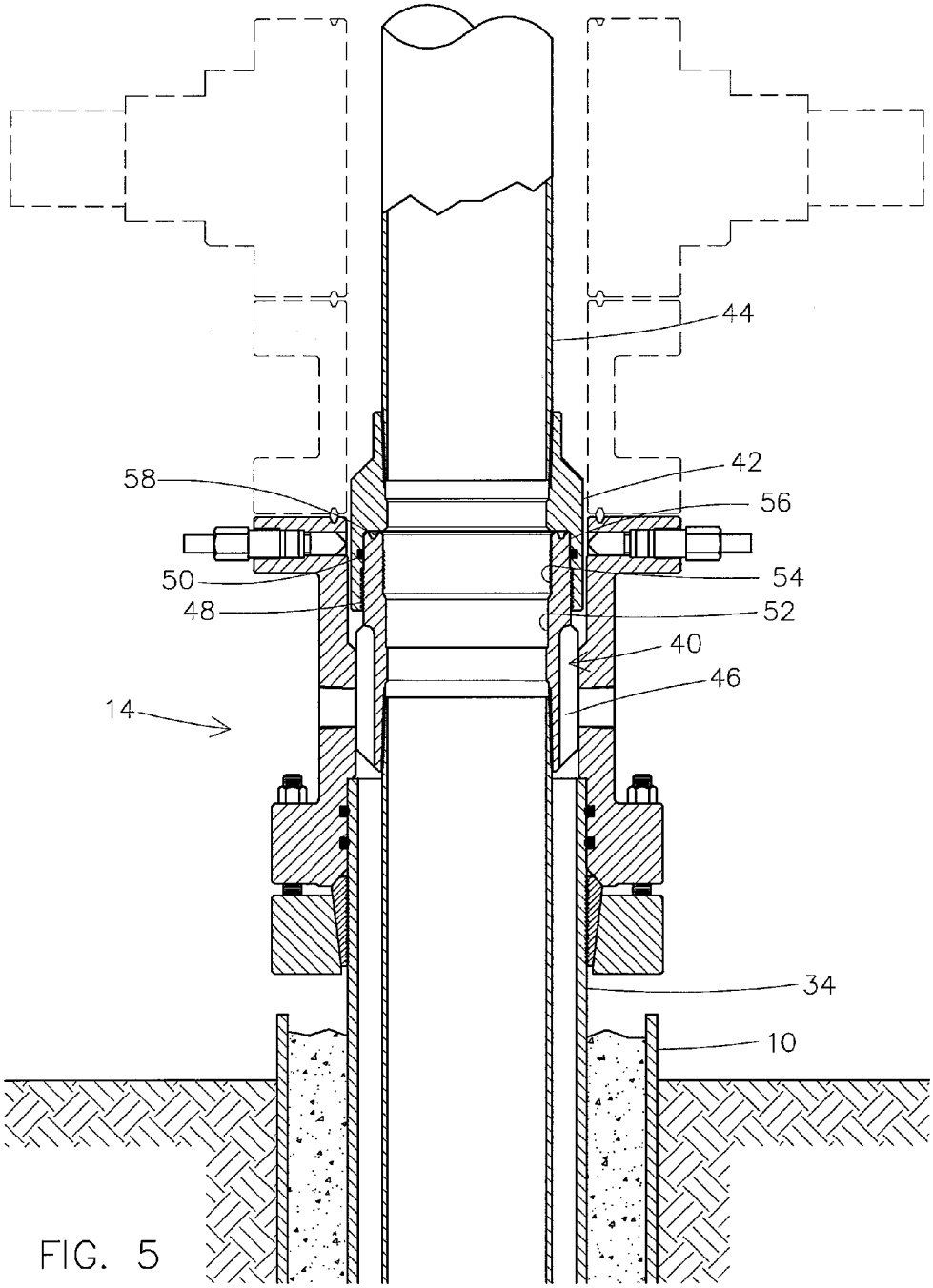
FIG. 5 schematically shows the landing of the production casing within a temporary wellhead housing utilizing an embodiment of the disclosed tubular connector member in preparation for cementing of the production casing.

FIG. 5 depicts one possible configuration of the tubular connector 40 during the cementing of the production casing 34, in which the tubular connector is landed within landing ring 12' of the surface casing 10 shown in FIG. 2. Alternatively, or in addition, the production casing 34 may be suspended by exterior ring 36 landed into casing collar 38 as shown in FIG. 3. The tubular connector 40 is run into the well with casing running tool 42, which seals on the tubular connector for cementing operations. Casing running tool 42 may comprise left-handed Acme threads which engage suspension threads 48. Casing running tool 42 is run into the well by casing joint 44. Lock-down screws 28 on the temporary wellhead housing 14 are tightened once the tubular connector 40 is in place to retain the tubular connector during cementing operations. During cementing operations, cement is circulated into the annulus between the production casing 34 and the open hole and the annulus between the production casing 34 and the surface casing 10, with cement circulating through the flutes 46 or other types of openings, holes or channels and exiting through annulus outlets 32.

Figure 6:
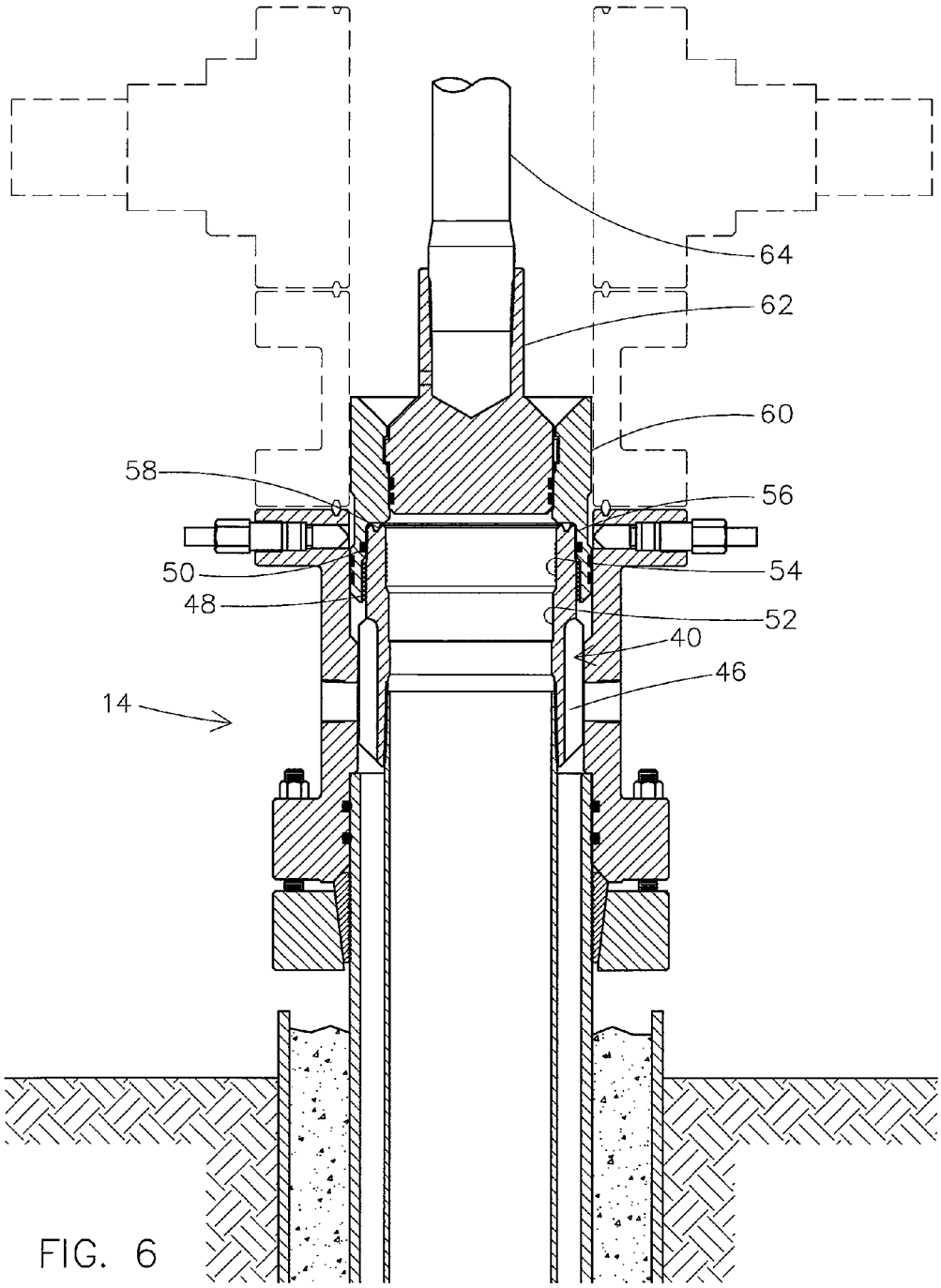
FIG. 6 schematically shows how a temporary pack-off member may be installed in embodiments of the invention.

Once the production casing 34 has been cemented, lock-down screws 28 are retracted and the running tool 42 is disconnected from the tubular connector 40 by right-hand rotation and a washout tool is run to just above the tubular connector and circulation initiated. The washout tool is removed and temporary pack-off member 60 is installed between the top joint of casing of the surface casing 10 and the top joint of the production casing 34 as depicted in FIG. 6. The temporary pack-off member 60 is installed by pack-off running tool 62 attached to drill pipe 64. Once the pack-off member is in place, the pack-off running tool 62 is released and withdrawn from the well, leaving the configuration depicted in FIG. 7 with the well ready for drilling operations in the production casing 34.

Figure 7:
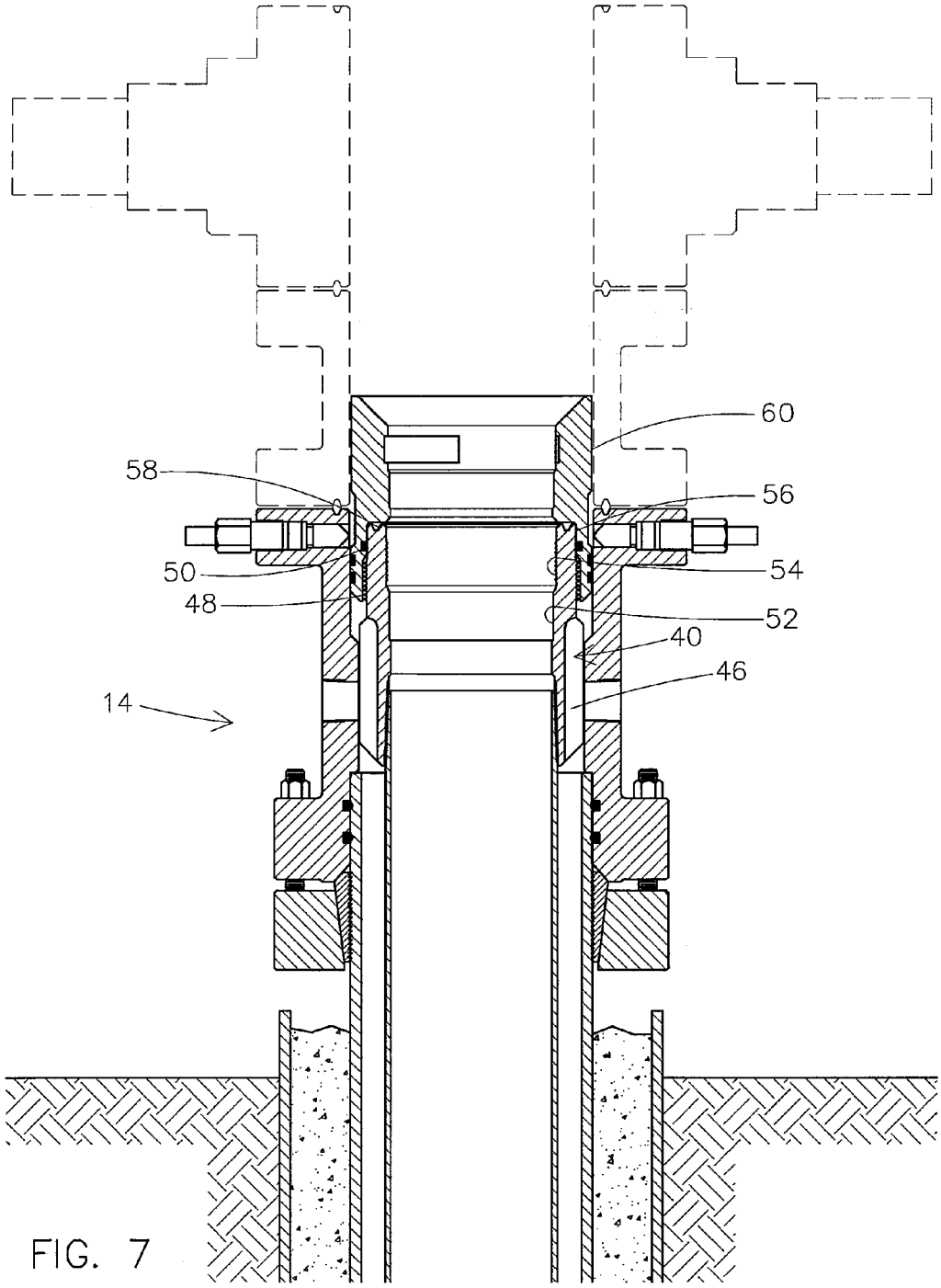
FIG. 7 schematically shows an embodiment of the temporary pack-off member after being installed.
Figure 8:
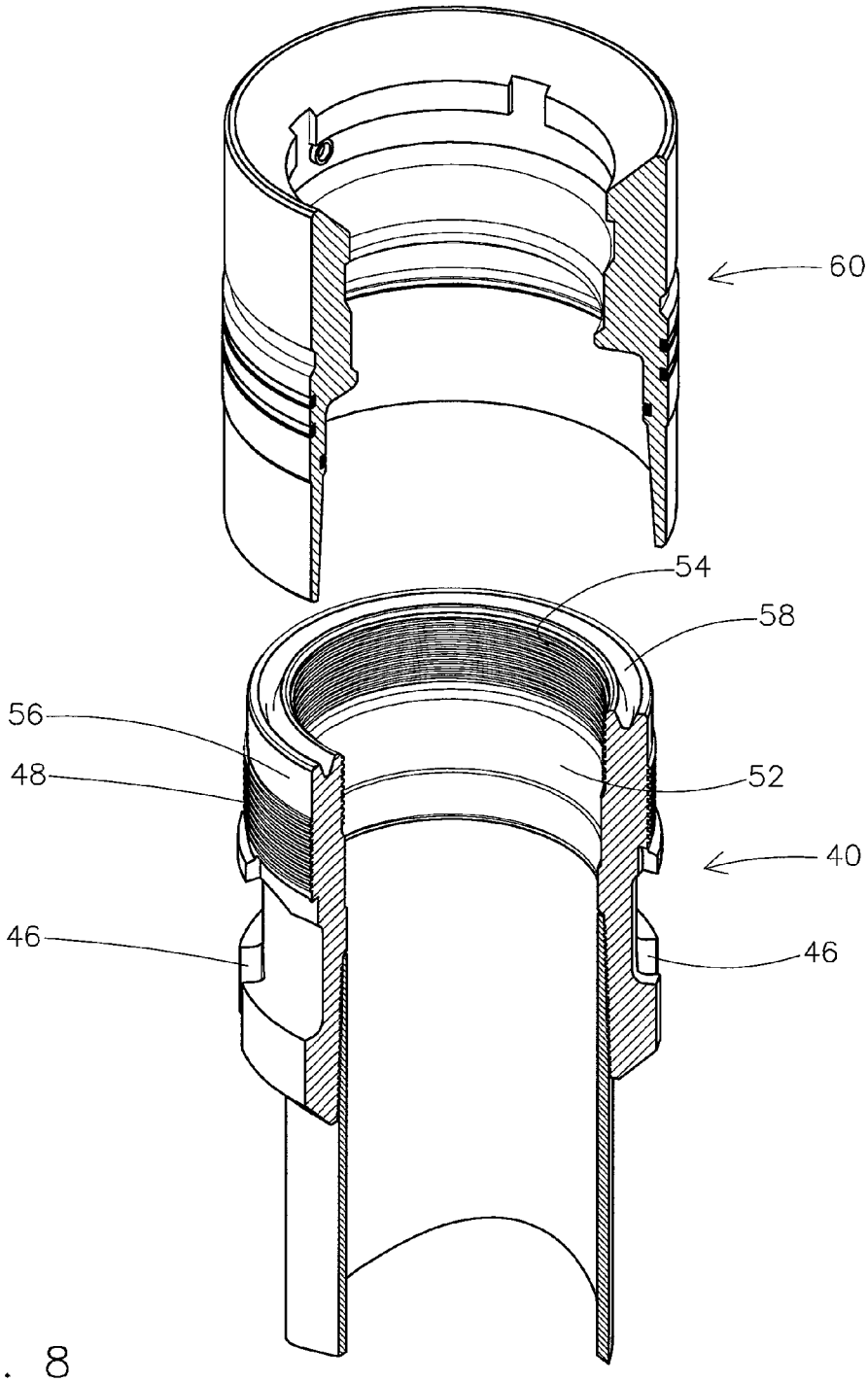
FIG. 8 shows partial cutaway perspective views of embodiments of the temporary pack-off member and the tubular connector member.
Figure 9:
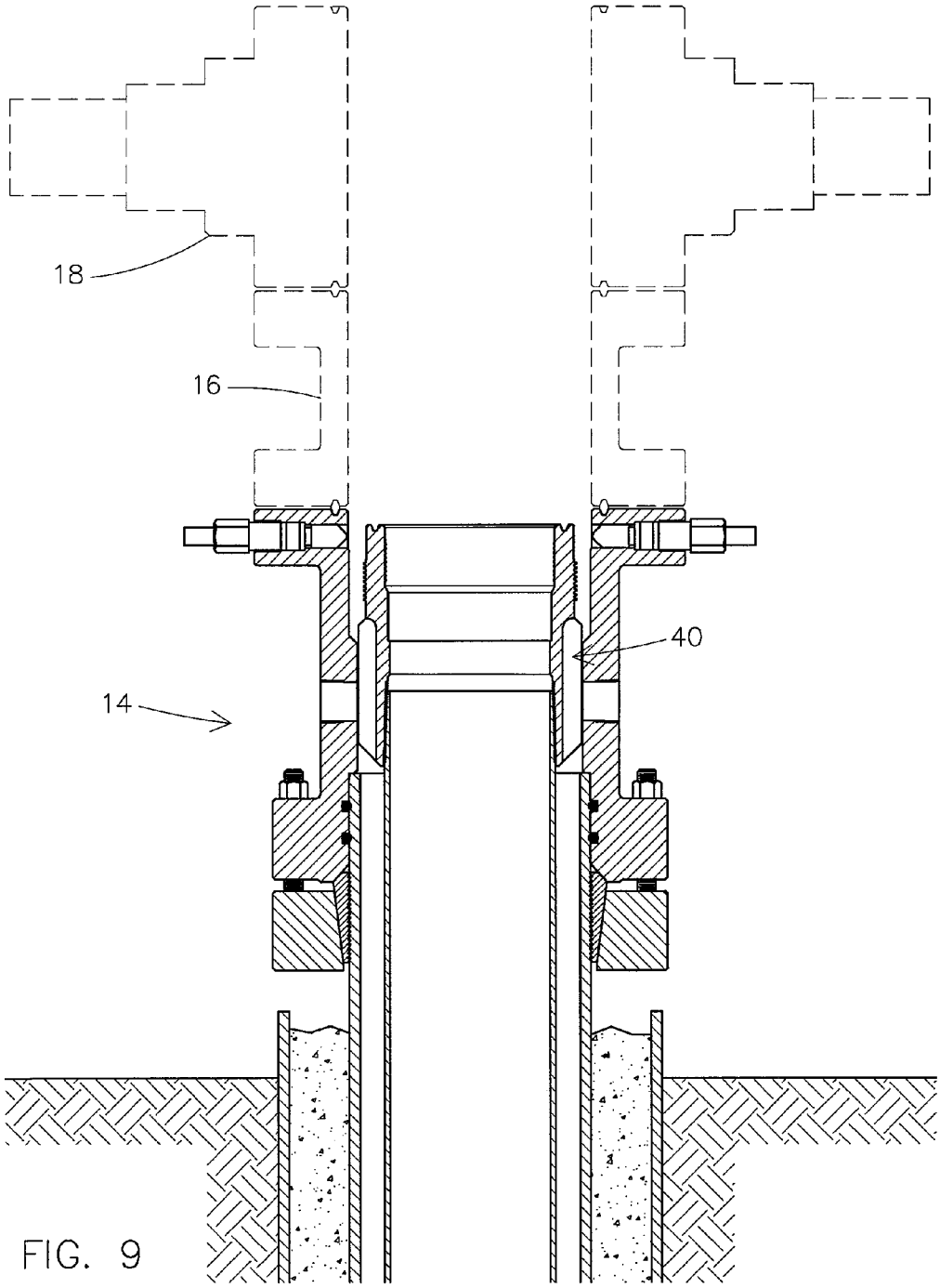
FIG. 9 shows the tubular connector member following the removal of the temporary pack-off member following completion of drilling operations in the production casing.
Figure 10:
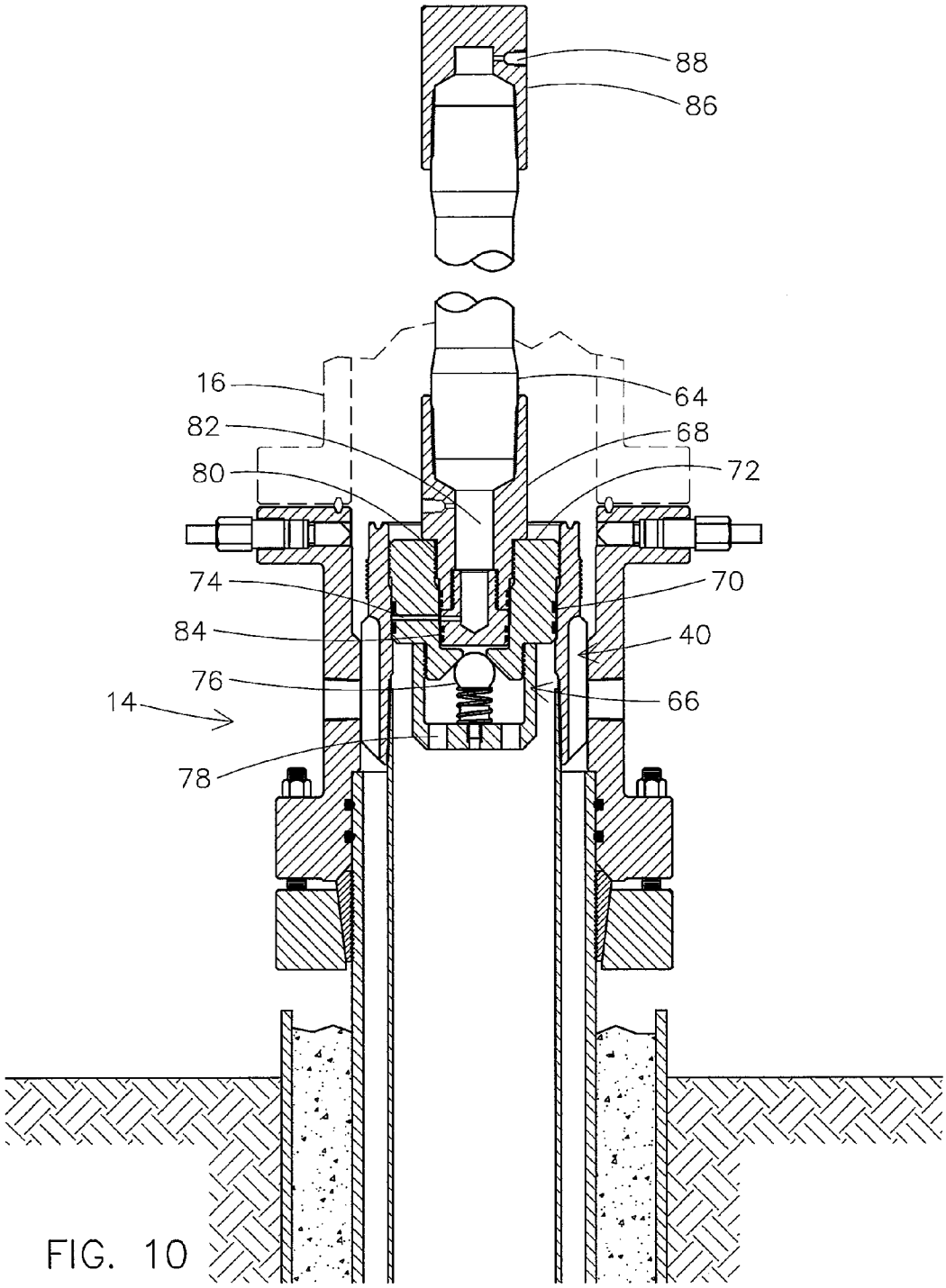
FIG. 10 schematically shows how a casing plug may be installed in embodiments of the tubular connector member.

As shown in FIG. 7, the temporary pack-off member 60 seals with tubular connector 40 by O-ring seal 50. The temporary pack-off member 60 provides a seal between the annulus of the production casing 34 and the surface casing 10. In addition, as shown in FIG. 7, the temporary pack-off member 60 has a funnel-like upper opening which provides a means for guiding tools through the tubular connector 40 without damaging it. The temporary pack-off member 60 also provides a means for pressure testing the blow-out preventer 18. FIG. 8 shows a detailed view of the temporary pack-off member 60 and the tubular connector 40, Once drilling operations have been completed in the production casing 34, the temporary pack-off member 60 is removed with pack-off running tool 62 leaving the configuration depicted in FIG. 9. The well is ready for installation of casing plug 66 as depicted in FIG. 10, which will allow the removal of the temporary wellhead housing 14 and the blow-out preventer 18. Casing plug 66 is installed with plug running tool 68, which holds the casing plug as it is placed in position and allows a pressure test of the plug. Casing plug 66 comprises a plug body 72 having O-ring seals 70 which seal against the seal bore 52 of the tubing connector 40. The plug body 72 comprises weep holes 74 which allow a pressure test to insure the seals of the casing plug 66 are holding. Casing plug 66 comprises a pump-through valve such as check valve 76 which allows the checking for pressure beneath the plug as well as venting pressure. The check valve 76 may either be installed with the initial installation of the casing plug 66 or the check valve may have a latching mechanism and installed by wireline into a check valve receiving bore of the plug. While not depicted in FIG. 10, the check valve 76 may be a two way valve. The casing plug 66 further comprises vent holes 78 which allow fluid or gas to be vented through the check valve 76. Casing plug 66 is attached within the tubing connector 40 by attachment means such as threads 80 or a latching mechanism. Plug running tool 68 comprises a plug test fluid conduit 82 through which a test fluid may be pumped to test the casing plug. The plug running tool 68 further comprises seal 84 to allow pressure testing of the casing plug 66. Pressure testing of the plug is accomplished by the use of test cap 86 which has pressure test connection 88.

Figure 11:
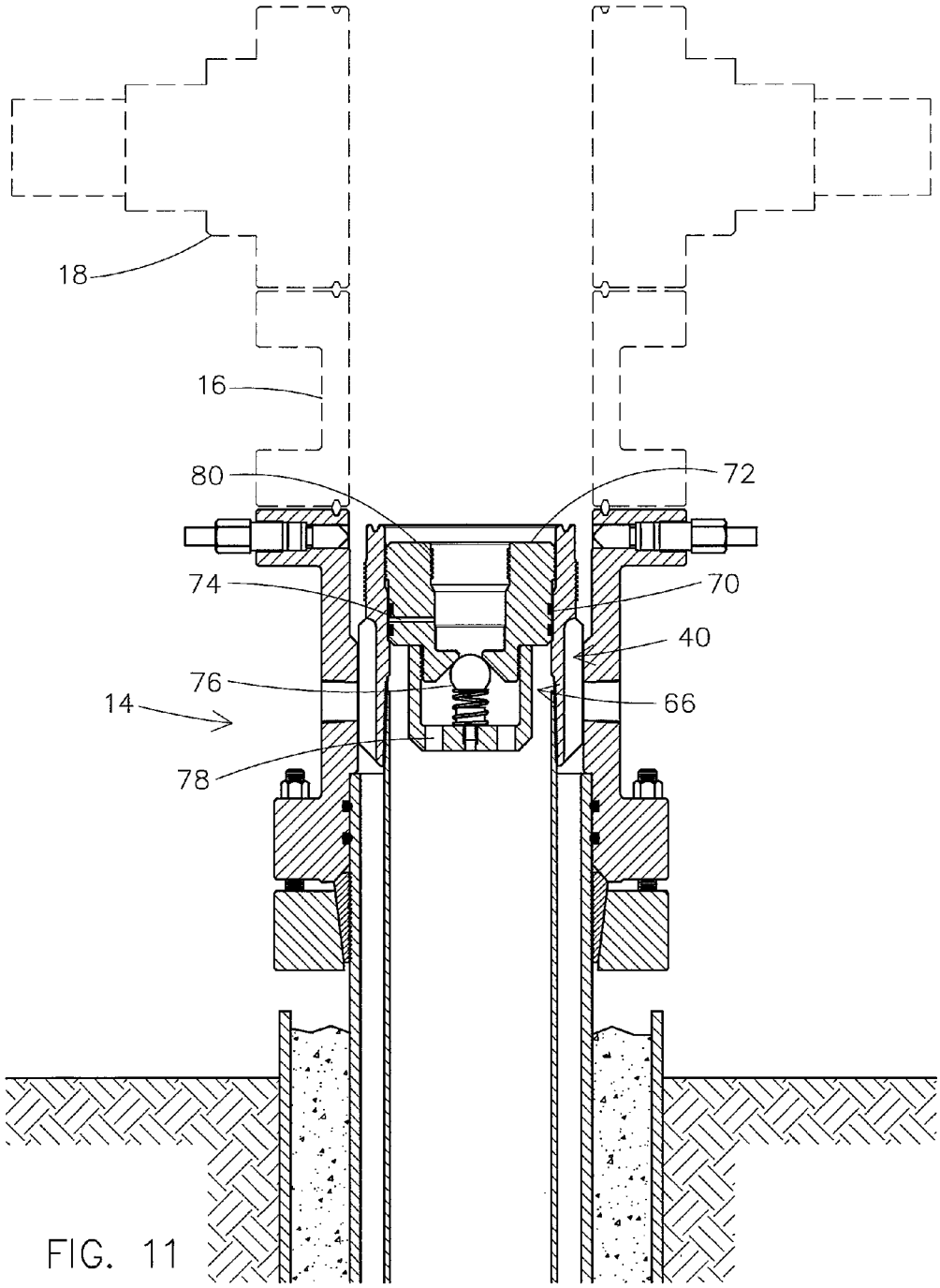
FIG. 11 schematically shows a casing plug in the tubular connector member following installation.
Figure 12A:
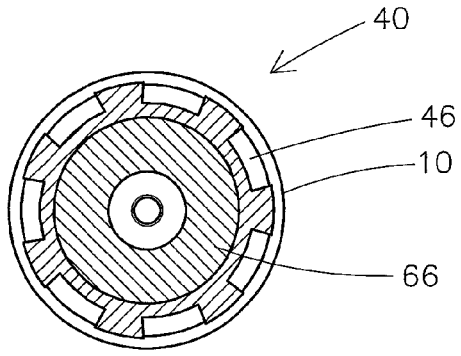
FIG. 12A shows a sectional view taken along line A-A of FIG. 12.
Figure 12:
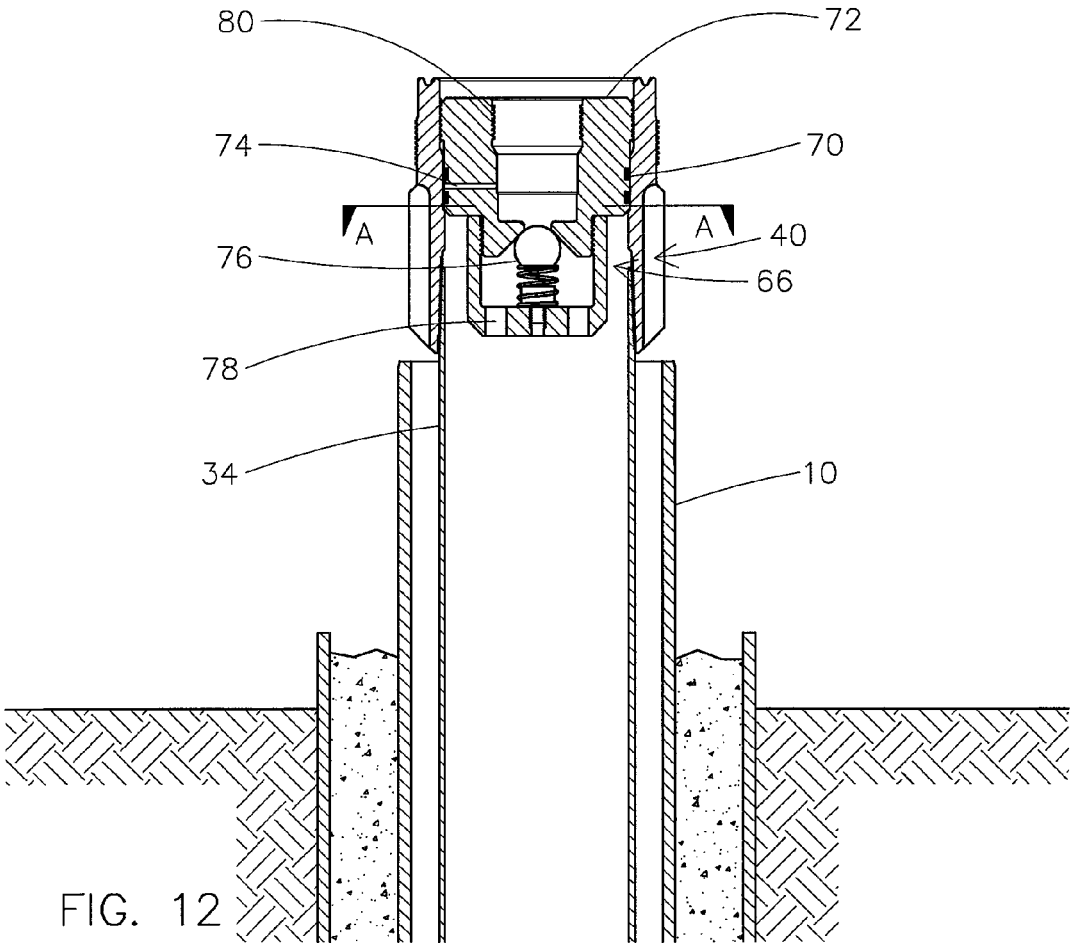
FIG. 12 schematically shows the resulting well configuration following removal of the reusable drilling head and blowout preventer, showing how the configuration of a well awaiting further completion operations.

FIG. 11 depicts the well configuration after the casing plug 66 has been successfully pressure tested and the plug running tool 68 has been removed, leaving the casing plug 66 disposed within the tubing connector 40. Detailed views of embodiments of the casing plug 66 and the tubing connector 40 are shown within FIGS. 13 and 14. At this point, the temporary wellhead housing 14 and the blow-out preventer 18 may be removed, leaving the configuration depicted in FIG. 12. FIG. 12A shows a top view of the casing plug 66 set within the tubing connector 40. The well is sealed at this point and the drilling rig may be moved off of the location.

When it is desired to initiate completion operations for the well, a production head 90 is installed. Production head 90 comprises a threaded flange 92 which threads onto threads 48 of the tubular connector 40. Production head 90 further comprises a low stress metal seal 94 which sits within ring groove 58 of the tubing connector. Sealing the production head 90 to the tubular connector 40 requires a deviation from conventional sealing ring technology. The tubular connector 40, because of the design constraints, is too thin for the stress induced by making up a conventional ring in a conventional groove. Thus, it is necessary to make a robust ring joint that uses an existing ring gasket, without overstressing the thin tubular connector. The inventors have determined that the R type metal gasket is unsuitable in certain casing configurations. The conventional groove for the RX and SR gaskets are also unsuitable. The inventors herein have determined that an acceptable joint may be realized by using a deep RX groove for ring groove 58, which allows a face-to-face makeup between threaded flange 92 and the production head 90 when an RX metal seal 94 is installed in the ring groove. The inventors have determined that an RX-49 ring gasket provides an acceptable metal seal 94.

Production head 90 further comprises a metal seal test seal 96 which provides a second closure which enables the pressure testing of the low stress metal seal 94. Test port 98 is a connection which allows pressure testing of the metal seal 94. The production head 90 further comprises a seal bore 100, which provides an internal sealing surface for test plugs, tubing hangers and other tools. Production head 90 is equipped with lock down screws 102 which may be utilized to retain wear bushings, tubing hangers, test plugs and other tools within the wellhead housing. Production head 90 further comprises a load shoulder 104 for suspending casing or tubing.

Figure 16:
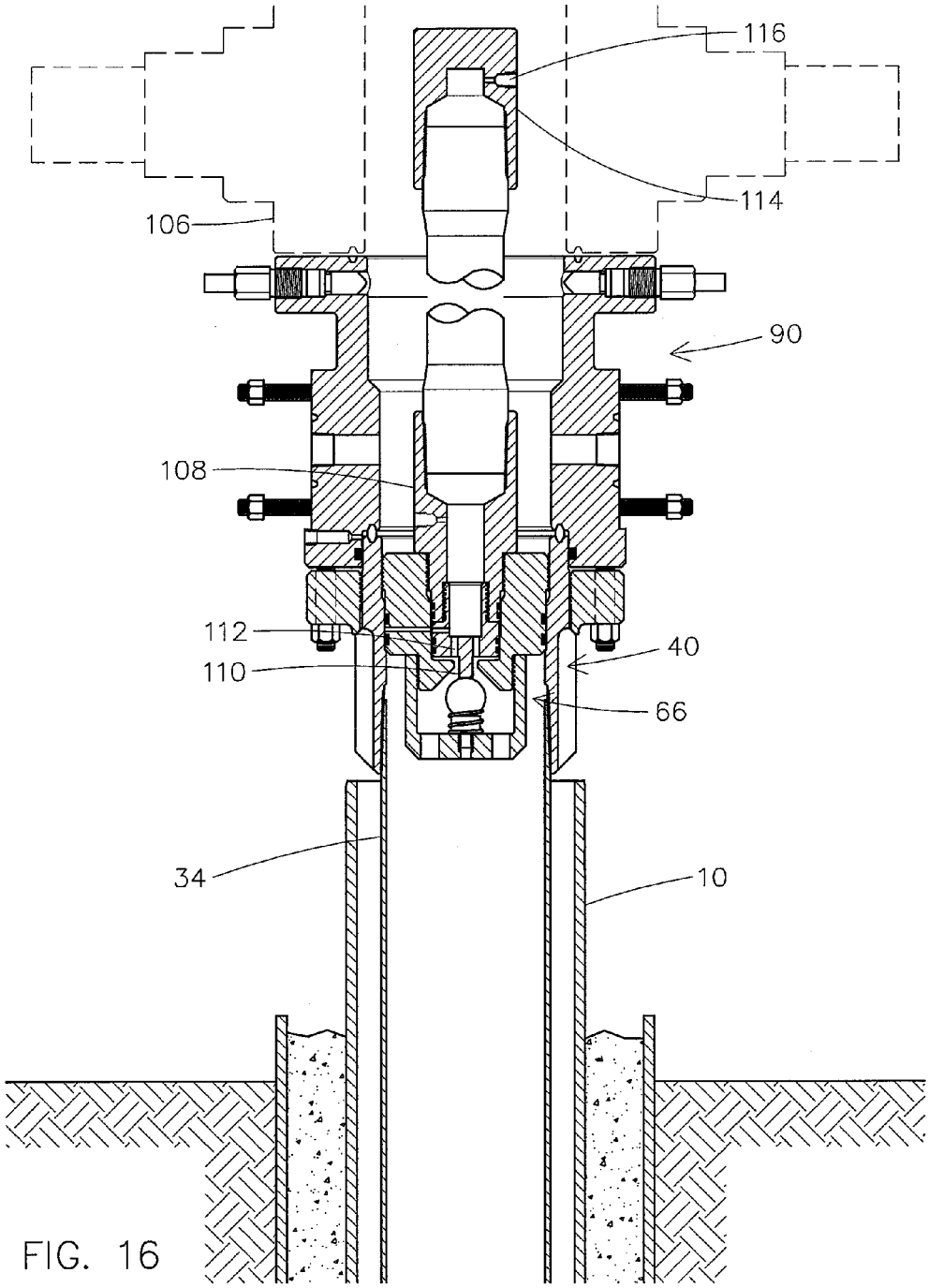
FIG. 16 schematically shows the removal of the casing plug.
Figure 17:
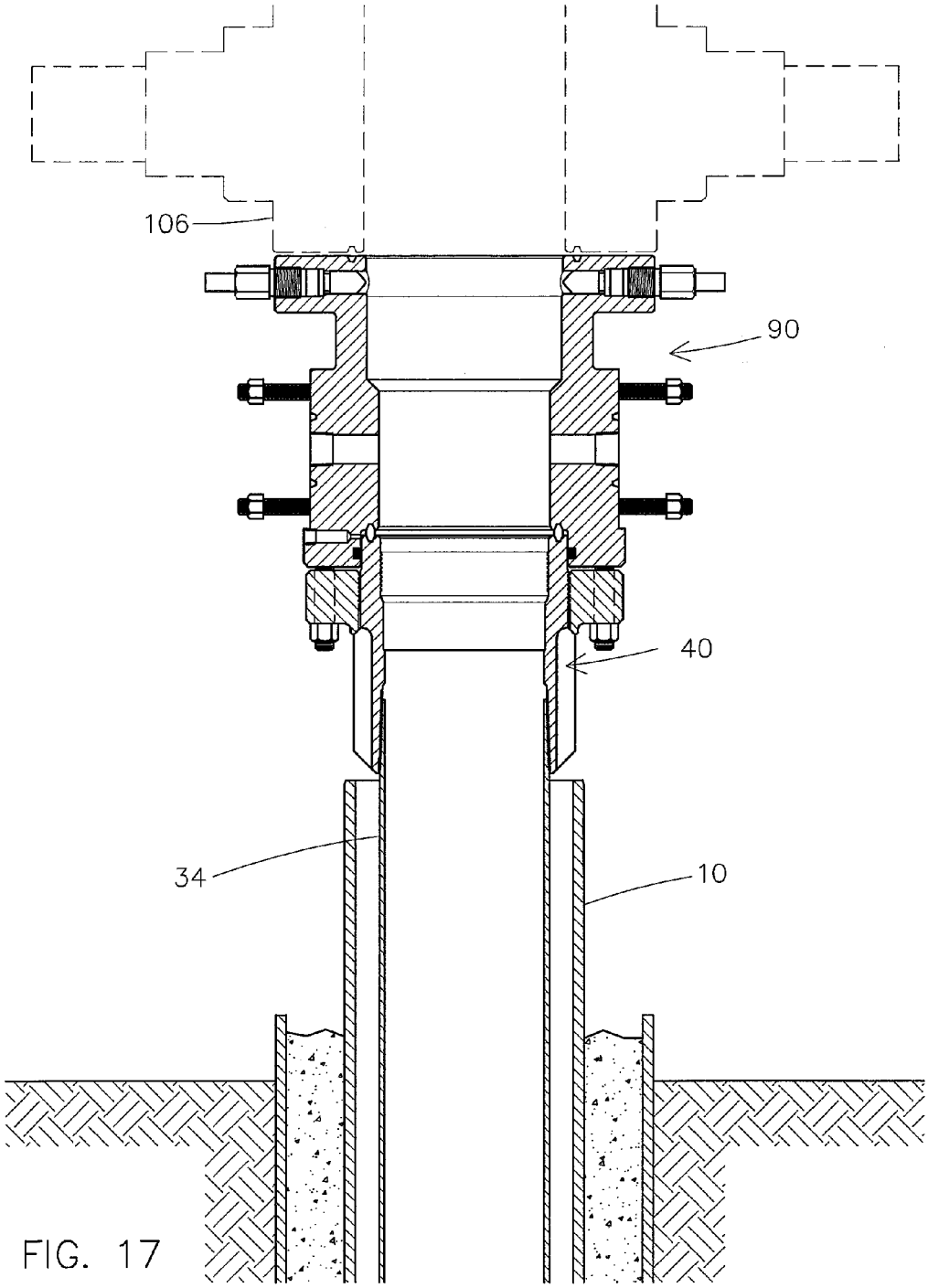
FIG. 17 schematically shows a well configuration prepared for installation of completion tubing.

Once production head 90 has been installed to tubular connector 40, the well is in the proper configuration for rigging up of a completion unit. A completion blowout preventer 106 is first attached to production head 90. As shown in FIG. 16, plug retrieval tool 108 is run in on tubing or drill pipe and attaches to casing plug 66, and utilizes plug check valve stinger 110 to upset check valve 76 to relieve well pressure which may have built up beneath the check valve. Retrieving tool weep holes 112 allow pressure to pass into the plug retrieving tool 108 into retrieving tool cap 114 to exit through retrieving tool vent port 116. Once pressure has been relieved, the casing plug 66 may be removed, resulting in the configuration shown in FIG. 17.

Figure 18:
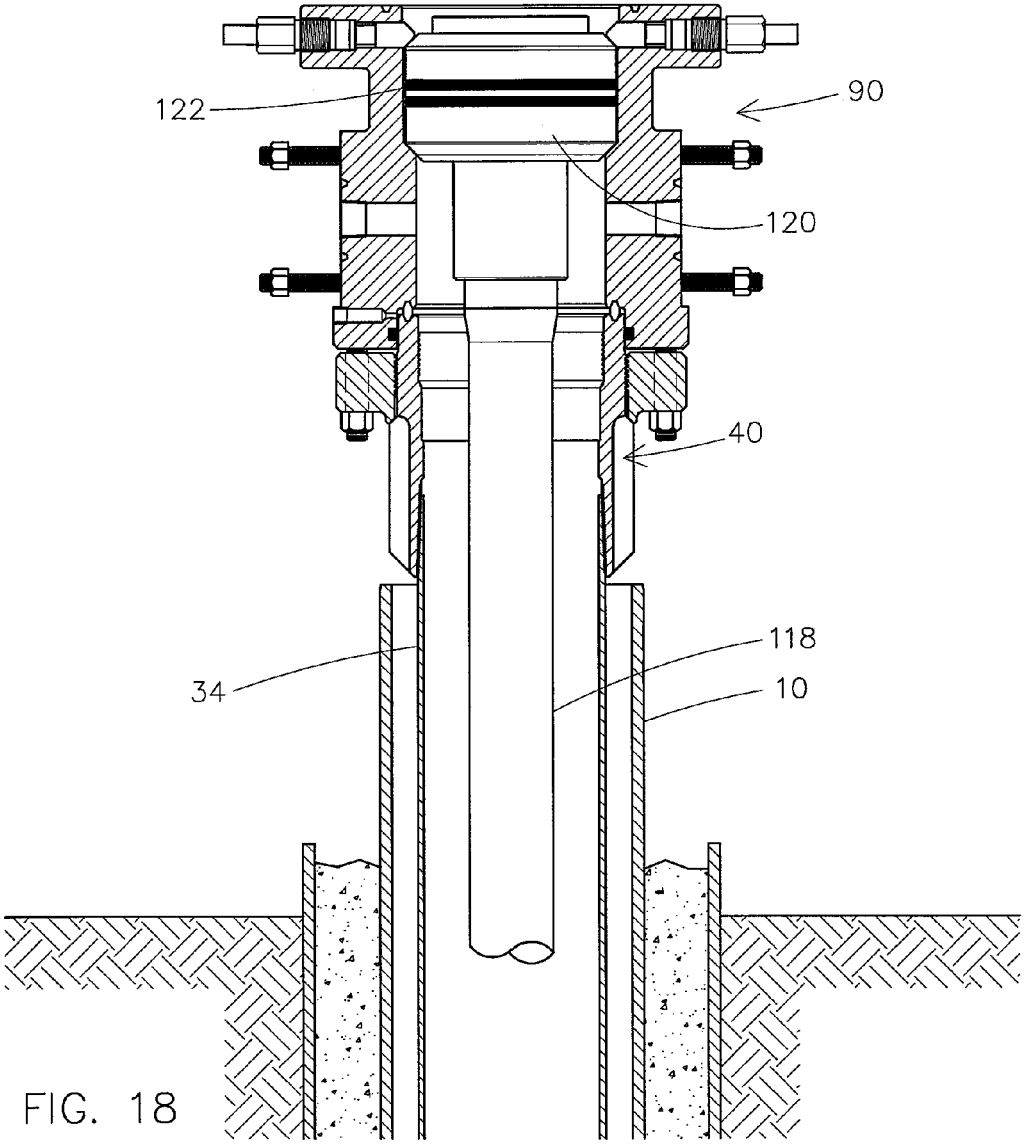
FIG. 18 schematically shows a well configuration after completion tubing has been installed.

As shown in FIG. 18, once the casing plug 66 has been removed, completion tubing 118 may be installed and suspended by tubing hanger 120. Tubing hanger 120 comprises seals 122 for sealing within the production head 90.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following appended claims.

What is claimed is:

1. A method of drilling a hydrocarbon well in a prepared drilling location comprising the following steps:

installing a conductor casing in the prepared drilling location;

drilling a first openhole section of well below the conductor casing;

setting and cementing a first casing string within the first openhole section, the first casing string comprising a plurality of individual joints of casing including a top joint of casing;

installing a temporary wellhead housing to the top joint of the first casing string;

drilling a second openhole section of well below the first casing string;

setting a second casing string within the first casing string and the second openhole section, the second casing string comprising a plurality of individual joints of casing including a top joint of casing, the top joint of casing comprising a tubular connector member, wherein the tubular connector member comprises means for attachment of a permanent wellhead housing, sealing means for sealing with a permanent wellhead housing, and an internal plug receiving section having means for receiving a plug having a pump-through valve;

cementing the second casing string within the first casing string and the second openhole section of well;

drilling out cement in the second casing string;

setting a plug within the internal plug receiving section; and removing the temporary wellhead housing, leaving the plug in place until well completion operations.

2. The method of claim 1 further comprising the step of installing a temporary pack-off member between the top joint of casing of the first casing string and the top joint of the second casing string after the cementing of the second casing string and the step of removing the temporary pack-off member after drilling in the second casing has been completed.

3. The method of claim 2 wherein the pack-off member comprises means for guiding tools into the second casing string.

4. The method of claim 2 wherein the pack-off member comprises means for pressure testing a blow-out preventer attached to the temporary wellhead housing.

5. The method of claim 1 wherein the tubular connector member comprises means for facilitating circulation around the second casing string.

6. The method of claim 5 wherein the means for facilitating circulation around the second casing string comprises the tubular connector having a fluted exterior.

7. The method of claim 1 wherein the first casing string comprises a reduced diameter landing member.

8. The method of claim 7 wherein the second casing string comprises an exterior ring having a larger outside diameter than the individual joints of casing of the second casing string and the method comprises the additional step of landing the exterior ring within the reduced diameter landing member of the first casing string.

9. The method of claim 8 wherein the exterior ring comprises means for facilitating circulation between the exterior ring and the reduced diameter landing member.

10. The method of claim 9 wherein the means for facilitating circulation between the exterior ring and the reduced diameter landing member comprises the exterior ring comprising a plurality of flutes.

11. The method of claim 1 wherein the internal plug receiving section comprises threads and the plug comprises threads compatible with the threads of the internal plug receiving section.

12. The method of claim 1 wherein the internal plug receiving section comprises latch attachment means and the plug comprises a latch compatible with the latch attachment means.

13. The method of claim 1 wherein the well completion operations comprise attaching a permanent wellhead housing to the tubular connector member.

14. The method of claim 13 wherein the permanent wellhead housing is attached to the tubular connector member by a threaded flange.

15. The method of claim 13 further comprising the utilization of a low stress metal sealing means between the permanent wellhead housing and the tubular connector member.

16. The method of claim 15 further comprising the utilization of a secondary seal which allows pressure testing of the low stress metal sealing means.

17. In hydrocarbon well drilling operations in which a bore hole is drilled by a drilling rig and the bore hole is lined by a production casing string concentrically disposed within a surface casing string and cemented therein, wherein bore hole pressures are controlled by a blowout preventer assembly, an apparatus allows the demobilization of the drilling rig and the removal of the blowout preventer assembly without a top joint of the production casing string disposed within a permanent wellhead and without a top joint of the surface casing string disposed within a permanent wellhead, wherein the apparatus comprises:

a tubular connector member attached to the top joint of the production casing string, the tubular connector comprising a landing shoulder for landing against the top joint of the surface casing string, the tubular connector member further comprising means for attachment of the permanent wellhead, sealing means for sealing with the permanent wellhead, and an internal plug receiving section having means for receiving a plug having a pump-through valve.

18. The apparatus of claim 17 wherein the tubular connector member comprises means for facilitating circulation around the production casing string.

19. The apparatus of claim 18 wherein the means for facilitating circulation around the production casing string comprises the tubular connector member having a fluted exterior.

20. The apparatus of claim 17 wherein the surface casing string comprises a reduced diameter landing member.

21. The apparatus of claim 20 wherein the production casing string comprises an exterior ring having a larger outside diameter than the individual joints of casing of the production casing string and the exterior ring is landed within the reduced diameter landing member of the surface casing string.

22. The apparatus of claim 21 wherein the exterior ring comprises means for facilitating circulation between the exterior ring and the reduced diameter landing member.

23. The apparatus of claim 22 wherein the means for facilitating circulation between the exterior ring and the reduced diameter landing ring comprises the exterior ring comprising a plurality of flutes.

24. The apparatus of claim 17 wherein the internal plug receiving section comprises threads and the plug comprises threads compatible with the threads of the internal plug receiving section.

25. The apparatus of claim 17 wherein the internal plug receiving section comprises latch attachment means and the plug comprises a latch compatible with the latch attachment means.

* * * * *